US006094778A

United States Patent [19]

Boukas

[11] Patent Number: 6,094,778

[45] Date of Patent: Aug. 1, 2000

[54] PORTABLE VACUUM CLEANER FOR ATTACHING TO A CAN OF COMPRESSED GAS FOR CREATING A SUCTION

[76] Inventor: Alex Boukas, 52 Upper Sheep Pasture Rd., East Setauket, N.Y. 11733

[21] Appl. No.: 09/129,436

[22] Filed: Aug. 5, 1998

[51] Int. Cl.[7] ..... A47L 5/16

[52] U.S. Cl. ..... 15/409; 15/406; 239/318

[58] Field of Search ..... 15/409, 406; 239/318, 239/340

[56] References Cited

U.S. PATENT DOCUMENTS

| | | | |
|---|---|---|---|
| 2,074,666 | 3/1937 | Patalano | 15/409 |
| 2,091,642 | 8/1937 | Lingenbrink | 15/409 |
| 2,634,902 | 4/1953 | Brown | 15/409 |
| 2,856,205 | 10/1958 | Coleman et al. | 15/409 |
| 3,971,096 | 7/1976 | Renholt | 15/326 |
| 4,055,870 | 11/1977 | Furutsutsumi | 15/409 |
| 4,240,173 | 12/1980 | Sherrill | 15/409 |
| 4,736,489 | 4/1988 | Egan | 15/409 |
| 4,915,245 | 4/1990 | Wouters et al. | 215/326 |
| 5,007,803 | 4/1991 | DiVito et al. | 417/137 |
| 5,142,730 | 9/1992 | Braks et al. | 15/327.5 |
| 5,443,653 | 8/1995 | Riley | 134/8 |
| 5,989,360 | 11/1999 | Hamilton | 15/405 |

FOREIGN PATENT DOCUMENTS

| | | | |
|---|---|---|---|
| 2553682 | 4/1985 | France | 15/409 |

*Primary Examiner*—Theresa T. Snider
*Attorney, Agent, or Firm*—Richard L. Miller, P. E

[57] ABSTRACT

A portable vacuum cleaner for attaching to a can of compressed gas having an output for creating a suction. The cleaner includes a body, a nozzle attached to one end of the body, and a receptacle attached to the other end of the body. The body includes a cap for attaching to the can of compressed gas, and which has a throughbore. The body further includes an external tube that has an intermediate portion, a forward portion, and a rear portion. The receptacle includes a tube and an air permeable bag. The body further includes an internal tube, a valve, and a trigger, which when pressed, opens the valve which allows compressed gas in the can of compressed gas to exit through its output and flow through the internal tube into the rear portion of the external tube and thereby create a suction in the external tube which causes dirt to be drawn through the nozzle, through the external tube, through the tube of the receptacle, and be captured in the air permeable bag. The nozzle is hollow and can be either cylindrically-shaped, conically-frustrum-shaped, or include a proximal portion, an intermediate portion forming a sump, a distal portion forming a trap, and a web to add rigidity to the nozzle as a result of its general serpentine shape, with the sump capturing any liquid passing therethrough, and with the trap maintaining the liquid in the sump.

14 Claims, 1 Drawing Sheet

FIG. 1
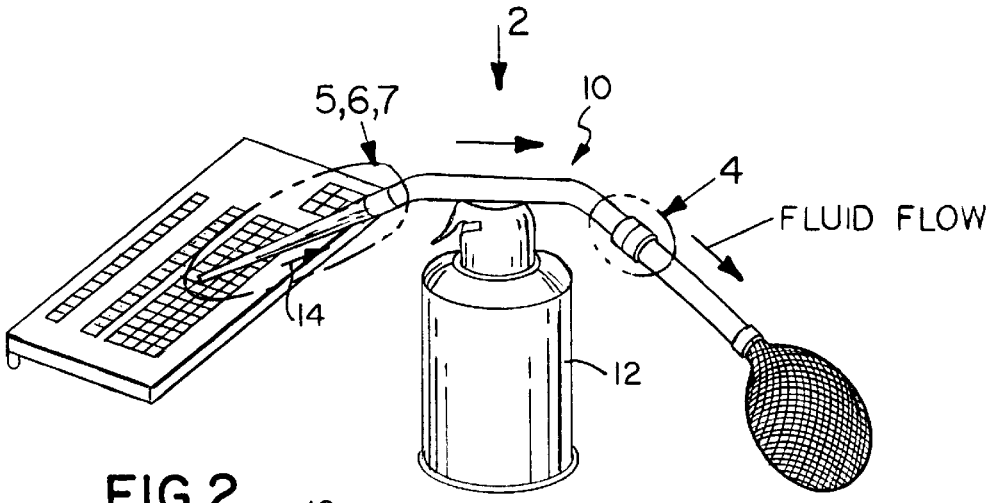
FIG.2
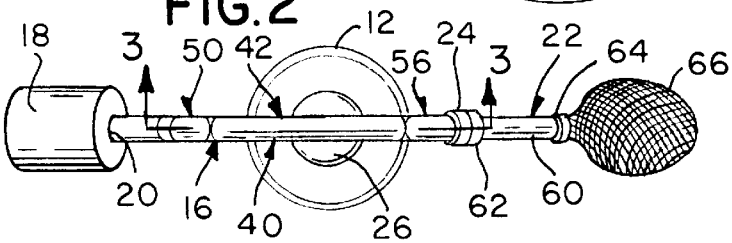
FIG. 4
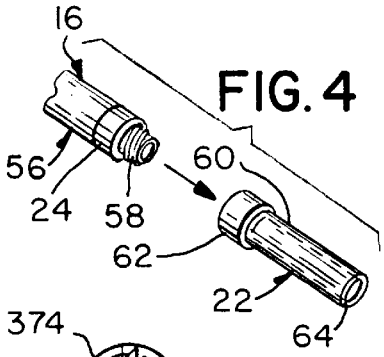
FIG.3
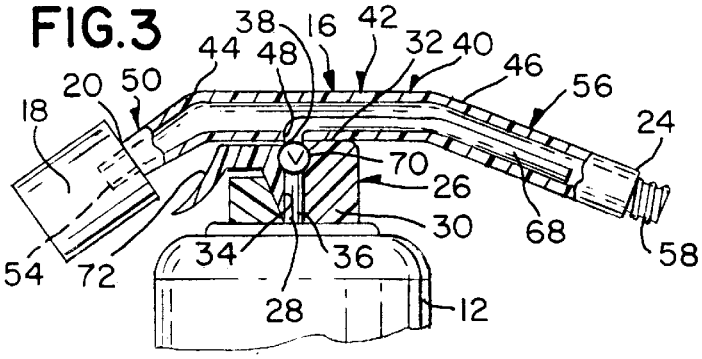
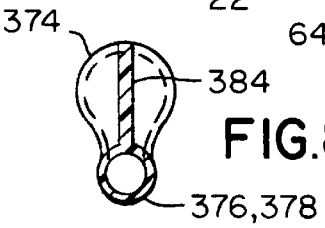
FIG.8
FIG.5
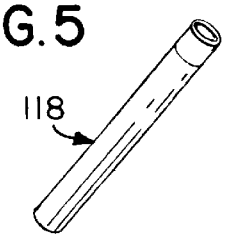
FIG.6
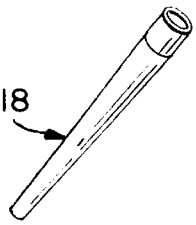
FIG.7
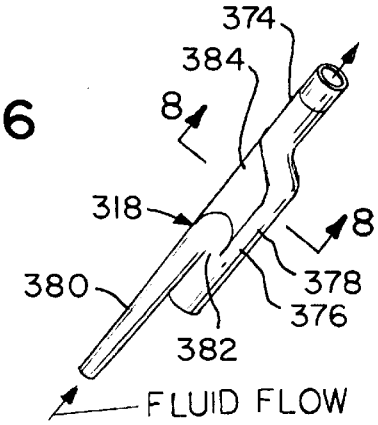

PORTABLE VACUUM CLEANER FOR ATTACHING TO A CAN OF COMPRESSED GAS FOR CREATING A SUCTION

BACKGROUND OF THE INVENTION

1. Field of the Invention

The present invention relates to a portable vacuum cleaner. More particularly, the present invention relates to a portable vacuum cleaner for attaching to a can of compressed gas for creating a suction.

2. Description of the Prior Art

Numerous innovations for vacuum related devices have been provided in the prior art that will be described. Even though these innovations may be suitable for the specific individual purposes to which they address, however, they differ from the present invention.

A FIRST EXAMPLE, U.S. Pat. No. 3,971,096 to Renholt teaches a pressurized air-driven suction device for dust, mud, liquids, and similar substances comprising one or more nozzles for ejecting pressurized air, and including appurtenant venturi tubes situated in an elongated tubular ejector housing, which at its outer end, if desired, may be provided with a silencer. A suction air pipe for supplying suction air is also mounted in said ejector housing, which is itself mounted through the end plate of a container, such as an oil drum having plug holes.

A SECOND EXAMPLE, U.S. Pat. No. 4,915,245 to Wouters et al. teaches a miniaturized vacuum generator powered by pressurized air, such as is commonly available in shop air lines. The generator includes a transducer coupled to the pressurized air line and utilizing the venturi principle to develop a vacuum at a vacuum port to which a vacuum hose may be coupled. This may be used in cleaning circuit boards and small electronic assemblies to pick off bits of solder, filings and other debris and contaminants which more conventional vacuum cleaners do not effectively remove. The apparatus includes an in-line filter for collecting such debris and contaminants and preventing them from being blown about by the exhaust. The apparatus may also be used as a pickup device for micro-chips and other miniature complements on an electronic assembly at a production line. Other uses of the device may be in the jewelry repair field where the debris to be picked up often contains dust and filings of precious metal and, occasionally, lost gemstones. The in-line filter admits of ready disassembly for recovery of such materials. The device works without moving parts and is fabricated to a considerable extent from static dissipative materials to prevent the buildup of electrostatic charge which might damage charge-sensitive micro-chips and other components being handled or worked upon.

A THIRD EXAMPLE, U.S. Pat. No. 5,007,803 to DeVito et al. teaches a compressed air-actuated pump including a venturi nozzle to create a vacuum condition within a fluid-tight pump body to pump in a liquid or slurry. When a given level of liquid is pumped in, a control circuit closes a flexible sleeve of a pneumatically actuated pinch valve positioned in an exhaust passageway of the venturi nozzle. Upon closing of the pinch valve, the exhaust stream from the venturi nozzle is diverted into the pump body to create a pressurized condition therein whereby the liquid or slurry previously accumulated therein is pumped out. The pump also includes a pair of variable flow control valves for independently adjusting the flow rates of compressed air through the venturi nozzle in the vacuum, pump-in and in the pressurized, pump-out cycles. Solid state opto-electronic liquid level sensors or appropriate pneumatic, electric or electro-pneumatic timing devices are employed to signal the opening and closing of the pinch valve. The flexible sleeve of the pinch valve, as well as all other parts in the pump are constructed of chemically-resistant materials to permit the pumping of erosive, corrosive and abrasive liquids and slurries.

A FOURTH EXAMPLE, U.S. Pat. No. 5,142,730 to Braks et al. teaches an apparatus for sucking up liquid spills of relatively small volumes comprising a container to which vacuum can be applied pneumatically, and a pick-up hose and wand. The apparatus is totally free from electrically operated components, so as to eliminate risk of fire-causing sparks during operation, and is light-weight, portable and small in size, so as to be disposed in handy positions adjacent to factory locations where spillage may occur.

A FIFTH EXAMPLE, U.S. Pat. No. 5,443,653 to Riley teaches a system for cleaning contaminants from small areas with minimal uncontained waste. The system includes a nozzle having a first aperture for ejecting a fluid and a second aperture for providing suction. The first nozzle ejects a pressurized fluid and the second nozzle provides suction. In a particular embodiment, the first and second apertures are coaxial. Thus, contaminants and residues are dislodged and dissolved by cleaning solvent ejected through the first aperture while the second aperture effectively removes the waste material from a small cleaning area.

It is apparent that numerous innovations for vacuum related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a portable vacuum cleaner for attaching to a can of compressed gas for creating a suction that avoids the disadvantages of the prior art.

ANOTHER OBJECT of the present invention is to provide a portable vacuum cleaner for attaching to a can of compressed gas for creating a suction that is simple and inexpensive to manufacture.

STILL ANOTHER OBJECT of the present invention is to provide a portable vacuum cleaner for attaching to a can of compressed gas for creating a suction that is simple to use.

BRIEFLY STATED, YET ANOTHER OBJECT of the present invention is to provide a portable vacuum cleaner for attaching to a can of compressed gas having an output for creating a suction. The cleaner includes a body, a nozzle attached to one end of the body, and a receptacle attached to the other end of the body. The body includes a cap for attaching to the can of compressed gas, and which has a throughbore. The body further includes an external tube that has an intermediate portion, a forward portion, and a rear portion. The receptacle includes a tube and an air permeable bag. The body further includes an internal tube, a valve, and a trigger, which when pressed, opens the valve which allows compressed gas in the can of compressed gas to exit through its output and flow through the internal tube into the rear portion of the external tube and thereby create a suction in the external tube which causes dirt to be drawn through the nozzle, through the external tube, through the tube of the receptacle, and be captured in the air permeable bag. The nozzle is hollow and can be either cylindrically-shaped, conically-frustrum-shaped, or include a proximal portion, an intermediate portion forming a sump, a distal portion forming a trap, and a web to add rigidity to the nozzle as a result of its general serpentine shape, with the sump capturing any liquid passing therethrough, and with the trap maintaining the liquid in the sump.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention being utilized with a can of compressed gas for cleaning a computer keyboard;

FIG. 2 is an enlarged diagrammatic top plan view taken generally in the direction of arrow 2 in FIG. 1 of the present invention;

FIG. 3 is an enlarged cross sectional view taken on line 3—3 in FIG. 2;

FIG. 4 is an enlarged exploded diagrammatic perspective view of the area generally enclosed by the dotted ellipse identified by arrow 4 in FIG. 1 of the coupling apparatus of the present invention;

FIG. 5 is an enlarged perspective view of the area generally enclosed by the dotted ellipse identified by arrow 5 in FIG. 1 of a first embodiment of the nozzle of the present invention;

FIG. 6 is an enlarged perspective view of the area generally enclosed by the dotted ellipse identified by arrow 6 in FIG. 1 of a second embodiment of the nozzle of the present invention;

FIG. 7 is an enlarged perspective view of the area generally enclosed by the dotted ellipse identified by arrow 7 in FIG. 1 of a third embodiment of the nozzle of the present invention; and FIG. 8 is an enlarged cross sectional view taken on line 8—8 in FIG. 7.

LIST OF REFERENCE NUMERALS UTILIZED IN THE DRAWING

10 portable vacuum cleaner for attaching to a can of compressed gas for creating a suction of the present invention
12 can of compressed gas
14 suction
16 body for attaching to can of compresses gas 12
18 nozzle
20 one end of body 16
22 receptacle
24 other end of body 16
26 cap of body 16 for attaching to can of compressed gas 12
28 output of can of compressed gas 12
30 lowermost face of cap 26 of body 16 for contacting can of compressed gas
32 uppermost face of cap 26 of body 16
34 throughbore in cap 26 of body 16
36 lowermost end of throughbore 34 in cap 26 of body 16
38 uppermost end of throughbore 34 in cap 26 of body 16
40 external tube of body 16
42 intermediate portion of external tube 40 of body 16
44 forward end of intermediate portion 42 of external tube 40 of body 16
46 rearward end of intermediate portion 42 of external tube 40 of body 16
48 aperture in intermediate portion 42 of external tube 40
50 forward portion of external tube 40 of body 16
54 concentrically smaller hollow neck of body 16
56 rear portion of external tube 40 of body 16
58 concentrically smaller hollow and externally threaded neck of body 16
60 tube of receptacle 22
62 one end of tube 60 of receptacle 22
64 other end of tube 60 of receptacle 22
66 air permeable bag of receptacle 22
68 internal tube of body 16
70 valve of body 16
72 trigger of body 16

First Embodiment

118 nozzle

Second Embodiment

218 nozzle

Third Embodiment

318 nozzle
374 proximal portion of nozzle 318
376 intermediate portion of nozzle 318
378 sump of intermediate portion 376 of nozzle 318
380 distal portion of nozzle 318
382 trap of distal portion 380 of nozzle 318
384 web

DETAILED DESCRIPTION OF THE PREFERRED EMBODIMENT

Referring now to the figures, in which like numerals indicate like parts, and particularly to FIG. 1, the portable vacuum cleaner for attaching to a can of compressed gas for creating a suction of the present invention is shown generally at 10 for attaching to a can of compressed gas 12 for creating a suction 14.

The configuration of the portable vacuum cleaner for attaching to a can of compressed gas for creating a suction 10 can best be seen in FIGS. 2–4, and as such will be discussed with reference thereto.

The portable vacuum cleaner for attaching to a can of compressed gas for creating a suction 10 comprises a body 16 for attaching to the can of compressed gas 12, a nozzle 18 attached to one end 20 of the body 16, and a receptacle 22 attached to the other end 24 of the body 16.

The body 16 comprises a cap 26 for attaching to the can of compressed gas 12, around its output 28, and has a lowermost face 30 for contacting the can of compressed gas 12 and an uppermost face 32.

The cap 26 of the body 16 further has a throughbore 34 that extends axially and vertically from, at its lowermost end 36, the lowermost face 30 of the cap 26 of the body 16 to, at its uppermost end 38, the uppermost face 32 of the cap 26 of the body 16, with the lowermost end 36 of the throughbore 34 in the cap 26 of the body 16 being for surrounding the output 28 of the can of compressed gas 12.

The body 16 further comprises an external tube 40 that is hollow, elongated, and slender.

The external tube 40 of the body 16 has an intermediate portion 42 that extends horizontally and perpendicularly from the uppermost face 32 of the cap 26 of the body 16.

The intermediate portion 42 of the external tube 40 of the body 16 has a forward end 44 that extends forwardly past the uppermost face 32 of the cap 26 of the body 16, a rearward end 46 that extends rearwardly past the uppermost face 32 of the cap 26 of the body 16, in an opposite direction, and an aperture 48 that extends laterally therein and is in fluid communication with the intermediate portion 42 of the external tube 40 and the uppermost end 38 of the throughbore 34 in the cap 26 of the body 16.

The external tube 40 of the body 16 further comprises a forward portion 50 that inclines forwardly from, and is in fluid communication with, the forward end 44 of the intermediate portion 42 of the external tube 40 of the body 16, to, the one end 20 of the body 16, which has a concentrically smaller hollow neck 54 extending axially therefrom and in fluid communication therewith, which interchangeably engages the nozzle 18.

The external tube 40 of the body 16 further comprises a rear portion 56 that inclines rearwardly from, and is in fluid communication with, the rearward end 46 of the intermediate portion 42 of the external tube 40 of the body 16, to, the other end 24 of the body 16, which has a concentrically smaller hollow and externally threaded neck 58 extending axially therefrom and in fluid communication therewith, which replaceably and receivingly engages the receptacle 22.

The receptacle 22 comprises a tube 60 that has one end 62 that is internally threaded and extends colinearly from, and replaceably and threadably engages, the concentrically smaller hollow and externally threaded neck 58 on the other end 24 of the body 16, to, the other end 64.

The receptacle 22 further comprises an air permeable bag 66 that is replaceably mounted to the other end 64 of the tube 60 of the receptacle 22.

The body 16 further comprises an internal tube 68 that is for originating at, and for being in fluid communication with, the output 28 of the can of compressed gas 12, and for extending axially upwardly therefrom, in the throughbore 34 in the cap 26 of the body 16, through the aperture 48 in the intermediate portion 42 of the tube 40 of the body 16, rearwardly through the intermediate portion 42 of the tube 40 of the body 16, and partially into the rear portion 56 of the tube 40 of the body 16, along side walls thereof.

The body 16 further comprises a valve 70 that is disposed in the cap 26 of the body 16, and is in fluid communication with, and selectively allows flow through, the internal tube 68 of the body 16.

The body 16 further comprises a trigger 72 that is operatively connected to the cap 26 of the body and the valve 70 of the body 16, and selectively operates the valve 70 of the body 16, and when pressed, opens the valve 70 of the body 16 which allows the compressed gas in the can of compressed gas 12 to exit through the output 28 of the can of compressed gas 12, and flow through the internal tube 68 in the body 16 into the rear portion 56 of the external tube 40 of the body 16, and thereby create the suction 14 in the external tube 40 of the body 16, which causes dirt to be drawn through the nozzle 18, through the external tube 40 of the body, through the tube 60 of the receptacle 22, and be captured in the air permeable bag 66 of the receptacle 22.

The specific configuration of a first embodiment of the nozzle 118 can best be seen in FIG. 5, and as such will be discussed with reference thereto.

The nozzle 118 is hollow and cylindrically-shaped.

The specific configuration of a second embodiment of the nozzle 218 can best be seen in FIG. 6, and as such will be discussed with reference thereto.

The nozzle 218 is hollow and conically-frustrum-shaped.

The specific configuration of a third embodiment of the nozzle 318 can best be seen in FIGS. 7 and 8, and as such will be discussed with reference thereto.

The nozzle 318 is hollow and comprises a proximal portion 374, an intermediate portion 376 that extends downwardly and forwardly from the proximal portion 374 of the nozzle 318 forming a sump 378, a distal portion 380 that extends rearwardly from the intermediate portion 376 of the nozzle 18 then forwardly forming a trap 382, and a web 384 that extends from the trap 382 of the distal portion 380 of the nozzle 318 to the proximal portion 374 of the nozzle 318 and to the sump 378 of the intermediate portion 376 of the nozzle 18 to add rigidity to the nozzle 318 as a result of its general serpentine shape, with the sump 378 of the intermediate portion 376 of the nozzle 318 capturing any liquid passing therethrough, and with the trap 382 of the distal portion 380 of the nozzle 318 maintaining the liquid in the sump 378 of the intermediate portion 376 of the nozzle 318.

It will be understood that each of the elements described above, or two or more together, may also find a useful application in other types of constructions differing from the types described above.

While the invention has been illustrated and described as embodied in a portable vacuum cleaner for attaching to a can of compressed gas for creating a suction, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable vacuum cleaner for attaching to a can of compressed gas having an output for creating a suction, said cleaner comprising:

a) a body having two ends with a nozzle attached to one end of said body and a receptacle attached to the other end of said body and further comprising a cap attached to said nozzle and said receptacle for attaching to the can of compressed gas, around the output of the can of compressed gas; said cap of said body having:

i) a lowermost face for contacting the can of compressed gas; and ii) an uppermost face.

b) a nozzle attached to one end of said body; and c) a receptacle attached to the other end of said body.

2. The cleaner as defined in claim 1, wherein said cap of said body further has a throughbore that extends axially and vertically from, at its lowermost end, said lowermost face of said cap of said body to, at its uppermost end, said uppermost face of said cap of said body, with said lowermost end of said throughbore in said cap of said body being for surrounding the output of the can of compressed gas.

3. The cleaner as defined in claim 2, wherein said body further comprises an external tube that is hollow, elongated, slender, and has an intermediate portion that extends horizontally and perpendicularly from said uppermost face of said cap of said body.

4. The cleaner as defined in claim 3, wherein said intermediate portion of said external tube of said body has a forward end that extends forwardly past said uppermost face of said cap of said body, a rearward end that extends rearwardly past said uppermost face of said cap of said body, in an opposite direction, and an aperture that extends laterally therein and is in fluid communication with said intermediate portion of said external tube and said uppermost end of said throughbore in said cap of said body.

5. The cleaner as defined in claim 4, wherein said external tube of said body further comprises a forward portion that inclines forwardly from, and is in fluid communication with, said forward end of said intermediate portion of said external tube of said body, to, said one end of said body, which has a concentrically smaller hollow neck extending axially therefrom and in fluid communication therewith, which interchangeably engages said nozzle.

6. The cleaner as defined in claim 5, wherein said external tube of said body further comprises a rear portion that inclines rearwardly from, and is in fluid communication with, said rearward end of said intermediate portion of said external tube of said body, to, said other end of said body, which has a concentrically smaller hollow and externally threaded neck extending axially therefrom and in fluid communication therewith, which replaceably engages said receptacle.

7. The cleaner as defined in claim 6, wherein said receptacle comprises a tube that has one end internally threaded and extends colinearly from, and replaceably and threadably engages, said concentrically smaller hollow and externally threaded neck on said other end of said body, to, its other end.

8. The cleaner as defined in claim 7, wherein said receptacle further comprises an air permeable bag that is replaceably mounted to said other end of said tube of said receptacle.

9. The cleaner as defined in claim 8, wherein said body further comprises an internal tube for originating at, and for being in fluid communication with, the output of the can of compressed gas, and for extending axially upwardly therefrom, in said throughbore in said cap of said body, through said aperture in said intermediate portion of said tube of said body, rearwardly through said intermediate portion of said tube of said body, and partially into said rear portion of said tube of said body, along side walls thereof.

10. The cleaner as defined in claim 9, wherein said body further comprises a valve that is disposed in said cap of said body, and is in fluid communication with, and selectively allows flow through, said internal tube of said body.

11. The cleaner as defined in claim 10, wherein said body further comprises a trigger that is operatively connected to said cap of said body and said valve of said body, and selectively operates said valve of said body, and when pressed, opens said valve of said body which allows compressed gas in the can of compressed gas to exit through the output of the can of compressed gas, and flow through said internal tube in said body into said rear portion of said external tube of said body, and thereby create a suction in said external tube of said body which causes dirt to be drawn through said nozzle, through said external tube of said body, through said tube of said receptacle, and be captured in said air permeable bag of said receptacle.

12. The cleaner as defined in claim 1, wherein said nozzle is hollow and cylindrically-shaped.

13. The cleaner as defined in claim 1, wherein said nozzle is hollow and conically-frustum-shaped.

14. The cleaner as defined in claim 1, wherein said nozzle is hollow and comprises a proximal portion, an intermediate portion that extends downwardly and forwardly from said proximal portion of said nozzle forming a sump, a distal portion that extends first rearwardly from said intermediate portion of said nozzle then forwardly forming a trap, and a web that extends from said trap of said distal portion of said nozzle to said proximal portion of said nozzle and to said sump of said intermediate portion of said nozzle to add rigidity to said nozzle as a result of its general serpentine shape, with said sump of said intermediate portion of said nozzle capturing any liquid passing therethrough, and with said trap of said distal portion of said nozzle maintaining the liquid in said sump of said intermediate portion of said nozzle.

* * * * *

UNITED STATES PATENT AND TRADEMARK OFFICE

CERTIFICATE OF CORRECTION

PATENT NO. : 6,094,778
DATED : August 1, 2000
INVENTOR(S) : Alex Boukas

It is certified that error appears in the above-identified patent and that said Letters Patent is hereby corrected as shown below:

Column 6,
Line 47, please delete the designation "a)". and
Please delete lines 13-14 of claim 1 (paragraphs b) and c) completely).

Signed and Sealed this

Twenty-third Day of April, 2002

*Attest:*

*Attesting Officer*

JAMES E. ROGAN
*Director of the United States Patent and Trademark Office*